US006764345B1

(12) United States Patent
Duesterhoeft et al.

(10) Patent No.: US 6,764,345 B1
(45) Date of Patent: Jul. 20, 2004

(54) ELECTRICAL CARD EDGE CONNECTOR WITH DUAL SHORTING CONTACTS

(75) Inventors: Scott Stephen Duesterhoeft, Etters, PA (US); Charles Dudley Copper, Harrisburg, PA (US); John Michael Landis, Camp Hill, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/445,602

(22) Filed: May 27, 2003

(51) Int. Cl.[7] ..... H01R 24/00
(52) U.S. Cl. ..... 439/637
(58) Field of Search ..... 439/637, 59–62, 439/325–328, 188, 636

(56) References Cited

U.S. PATENT DOCUMENTS 3,903,385 A * 9/1975 Moyer et al. ..... 200/51.1
4,087,151 A * 5/1978 Robert et al. ..... 439/188
5,277,607 A 1/1994 Thumma et al.
5,366,382 A 11/1994 Thumma

* cited by examiner

*Primary Examiner*—Ross Gushi

(57) ABSTRACT

A contact system includes at least one opposed pair of contacts. Each of the contacts has a resilient rear leg, a guide section extending from the rear leg, and a contact interface extending from the guide section. The contact interface includes a furcated surface adapted to establish multiple points of contact with a mating contact interface. The furcated surface includes a first contact beam and a second contact beam separated by a slot. At least one contoured footing extends from one of the first and second contact beams to establish multiple contact points with a mating interface.

19 Claims, 4 Drawing Sheets

ELECTRICAL CARD EDGE CONNECTOR WITH DUAL SHORTING CONTACTS

BACKGROUND OF THE INVENTION

This invention relates generally to electrical connectors for printed circuit board assemblies, and more specifically to a card edge connector including shorting contacts.

Typically, a mother board and one or more daughter boards are used to transfer signals between respective assemblies used in a computer or other electronic equipment. In some types of equipment, the mother and daughter boards may be arranged perpendicular to each other, sometimes referred to as a "card edge" configuration, depending upon the design of the overall product. A card edge connector extends between and couples the mother and daughter boards with a number of opposed electrical contacts. One end of each of the contacts is secured to the mother board and the opposite end of each of the contacts is fitted within a slot in the connector such that a daughter board may be received in the slot between the ends of opposed contacts. When the daughter board is removed from the slot, the opposed contacts come together to form an electrical shorting circuit through the connector. The reliability of these shorting contacts is influential to the efficiency of the associated equipment.

Conventionally, the card edge contacts are bent or bowed members which engage one another across an entire width of the respective contacts when the daughter board is removed. A dimple has sometimes been used on a surface of the shorting contacts to obtain contact stress against an opposing contact. Dust and debris, however, may collect at the interface between the mother board and the daughter board, or an oxide film may form on the opposing contacts of the edge connector. Debris and films may compromise the electrical connection between the opposed shorting contacts and may result in malfunction of the electronic equipment.

Shorting contacts have been developed which include radiused protrusions such that when the protrusions are located opposite one another in a housing, wiping movement between the protrusions creates a moving point of connection which overcomes film or debris on the contacts to improve the reliability of the shorting connection between the contacts. See, for example, U.S. Pat. Nos. 5,277,607 and 5,366,382. The protrusions, however, may become misaligned with one another and compromise the shorting connection. Additionally, the protrusions are designed to separate when a daughter board is inserted into the connector in order to break the shorting connection. However, if the daughter board is incompletely or incorrectly inserted into the connector, the connection between shorting contacts will be broken and electrical malfunction and component damage may result.

BRIEF DESCRIPTION OF THE INVENTION

In accordance with an exemplary embodiment of the invention, a contact system comprises at least one opposed pair of contacts. Each of the contacts of the pair comprise a resilient rear leg, a guide section extending from the rear leg, and a contact interface extending from the guide section. The contact interface comprises a furcated surface adapted to establish multiple points of contact with a mating contact interface.

Optionally, the furcated surface comprises a first contact beam and a second contact beam separated by a slot. At least one contoured footing extends from one of the first and second contact beams to establish multiple contact points with a mating interface. In one embodiment three separate points of contact are established with a mating contact interface.

According to another exemplary embodiment of the invention, an electrical connector comprises a pair of contacts arranged opposed to one another. Each of the contacts comprise a furcated contact interface, and the furcated contact interfaces of the pair of contacts engage one another until a printed circuit board is fully inserted between the contact interfaces.

According to another exemplary embodiment, an electrical connector comprises a housing configured to receive a circuit board and comprising at least one tapered interior wall. A pair of contacts are provided in the housing and are arranged opposed to one another. At least one of the pair of contacts comprises a resilient rear leg situated adjacent the tapered interior wall and a resilient contact section extending from the rear leg. The contact section includes a contact interface comprising at least one contact beam adapted to create separate first and second points of contact when the contact interface is engaged to a mating contact interface.

According to another exemplary embodiment of the invention, an electrical card edge connector is provided. The connector comprises a housing configured to receive an edge of a circuit board, and first and second contacts situated in the housing and arranged in a mating opposite pair. At least one of the first and second contacts comprises a resilient rear leg situated adjacent a tapered interior wall of the housing, and a guide section extending from the rear leg. The guide section engages the circuit board as the circuit board is received in the housing and a resilient contact interface extends from the guide section. The contact interface comprises a furcated contact interface engaging a mating contact interface until the circuit board is fully inserted between the first and second contacts. The resilient leg flexes when the circuit board engages the guide section to receive the printed circuit board without separating the contact interfaces from one another until the circuit board is inserted a predetermined distance into the slot.

DETAILED DESCRIPTION OF THE INVENTION

Figure 1:
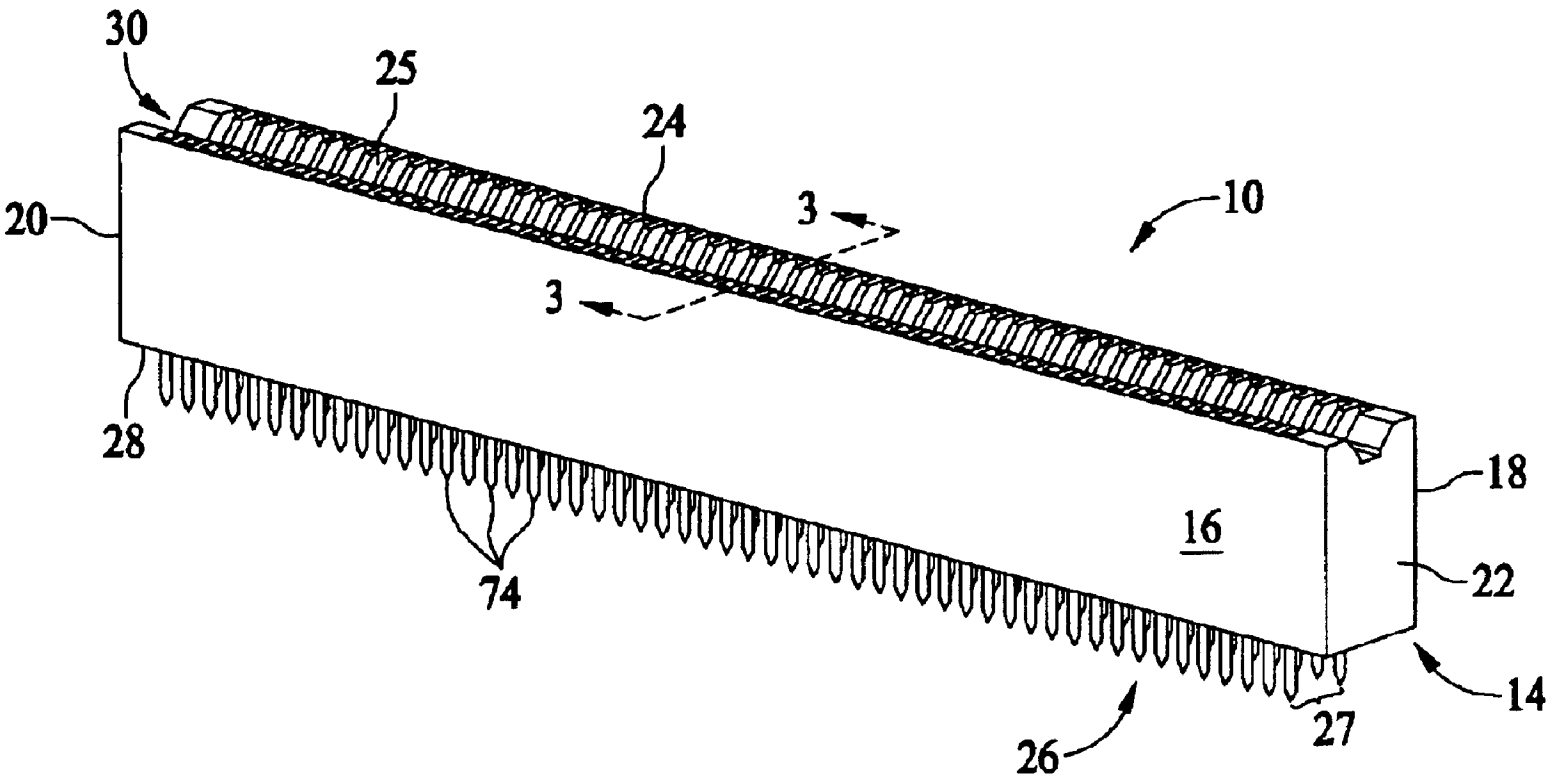
FIG. 1 is a perspective view of a card edge connector formed in accordance with an exemplary embodiment of the invention.

FIG. 1 is perspective view of a card edge connector 10 formed in accordance with an exemplary embodiment of the invention. Connector 10 includes a nonconductive housing 14 having elongated side walls 16, 18 and end walls 20, 22 arranged in a substantially rectangular configuration. An upper edge 24 of the housing 14 is slotted to define a number of lateral notches 25 that receive shorting contacts 26. The shorting contacts 26 are arranged in contact pairs 27 that are situated opposite one another in the lateral notches 25 of the housing 14. The shorting contacts 26 extend outward from the housing 14 for a predetermined distance from a lower edge 28 of the housing 14 for connection to a structure such as a printed circuit board, or more specifically a mother board (not shown in FIG. 1). While in the illustrated embodiment the contacts 26 are configured for through-hole connection to the mother board, it is appreciated that the contacts 26 may likewise be adapted for surface mounting to the mother board in an alternative embodiment.

A central longitudinal slot 30 extends along a length of an upper edge 24 of the housing 14 and is configured to receive a printed circuit board, such as a daughter board (not shown in FIG. 1), therein for connection to the contacts 26 within the lateral notches 25 of the housing 14.

As explained in some detail below, the contacts 26 form a shorting interface with redundant points of engagement or points of contact, and are configured for a mate-before-break engagement with a daughter board inserted into the longitudinal slot 30. The redundant contact points reduce the potential for poor electrical connection between the shorting contacts 26 even when the contacts 26 are misaligned. The contacts 26 are also configured to ensure that partial or incomplete insertion of the daughter board will not prematurely interrupt a shorting connection between the contacts 26.

Figure 2:
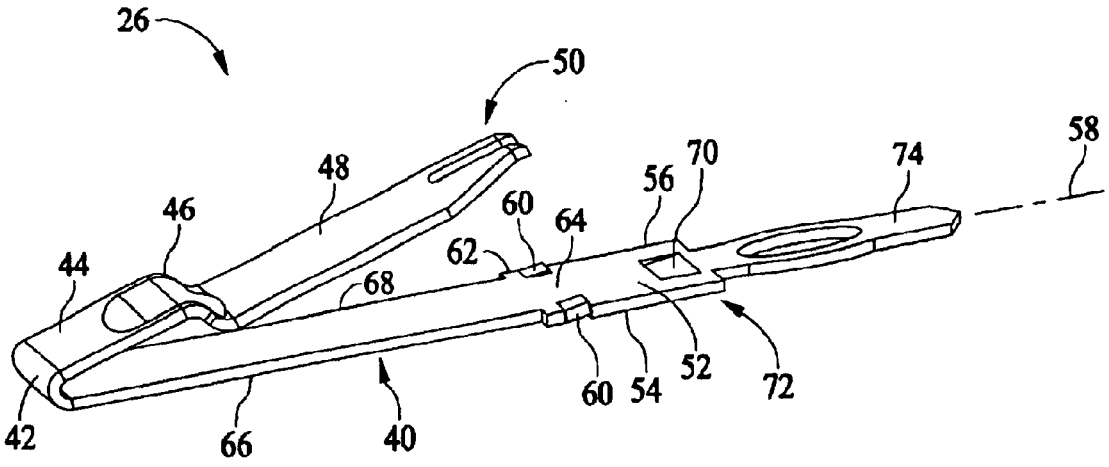
FIG. 2 is a perspective view of a shorting contact for the connector shown in FIG. 1.

FIG. 2 illustrates a shorting contact 26 formed in accordance with an exemplary embodiment of the invention and adapted for use in the connector 10 (shown in FIG. 1). Contact 26 is fabricated from a strip of electrically conductive material, such as beryllium copper in an exemplary embodiment. Contact 26 is formed with a flat rear leg 40 and a generally U-shaped bend 42 at an upper end thereof. A flat guide section 44 extends from the bend 42 at an acute angle away from the rear leg 40. A transition section 46 extends from the guide section 44 and is bent or oriented angularly from the guide section 44 in a direction toward the rear leg 40. A shorting contact section 48 extends from an end of the transition section 46 opposite the guide section 44 and extends outwardly and away from the rear leg 40. The bent configuration of the contact 26 provides a resiliency so that the shorting contact section 48 is biased in a direction away from the rear leg 40. The shorting contact section 48 includes a bifurcated shorting contact interface 50, described below, on a distal end thereof. The contact interfaces 50 of contacts 26 in a contact pair 27 engage one another to form a shorting electrical connection through the connector 10 (shown in FIG. 1). The contact interfaces 50 of contacts 26 in a contact pair 27 provides redundant points of contact between a contact pair 27 when contacts 26 are located within the housing 14 (shown in FIG. 1) and located opposite one another.

In the illustrative embodiment, the guide section 44 extends at a lesser angle of inclination (measured relative to the rear leg 40) than the shorting contact section 48, although it is recognized that in alternative embodiments other relative orientations of the rear leg 40, the guide section 44 and the shorting contact section 48 may be employed.

The rear leg 40 of the contact 26 includes a widened head section 52 of an increased lateral dimension measured between side edges 54 and 56. The head section 52 extends along and is generally perpendicular to a longitudinal axis 58 of the rear leg 40. The head section 52 is located a predetermined distance from the bend 42, and the head section 52 includes punched tabs 60 bent upwardly therefrom on either lateral side edge 54, 56 at an upper end 62 of the head section 52. A reduced width section 64 of reduced cross sectional area extends between the tabs 60. The section 64 has a lateral width (measured perpendicular to the longitudinal axis 58) that is less than a width between side edges 66 and 68 and a remainder of the rear leg 40 located between the head section 52 and the bend 42. As explained further below, the section 64 would permit the body section 40 to flex when a printed circuit board, such as a daughter board, is inserted into the longitudinal slot 30 of the connector 10.

A positioning tab 70 is punched from a central portion of the head section 52 at a lower end 72 thereof, and the positioning tab 70 is bent downwardly and away from the tabs 60. The positioning tab 70 locates the body section 40 in a desired position within the housing 14 of the connector 10. A compliant pin lead 74 extends from the lower end 72 of the head section 52 and provides a solderless connection to a printed circuit board, such as a motherboard. It is contemplated that in alternative embodiments, solder tails or other known connective schemes could be employed in lieu of the compliant pin lead 74.

Figure 3:
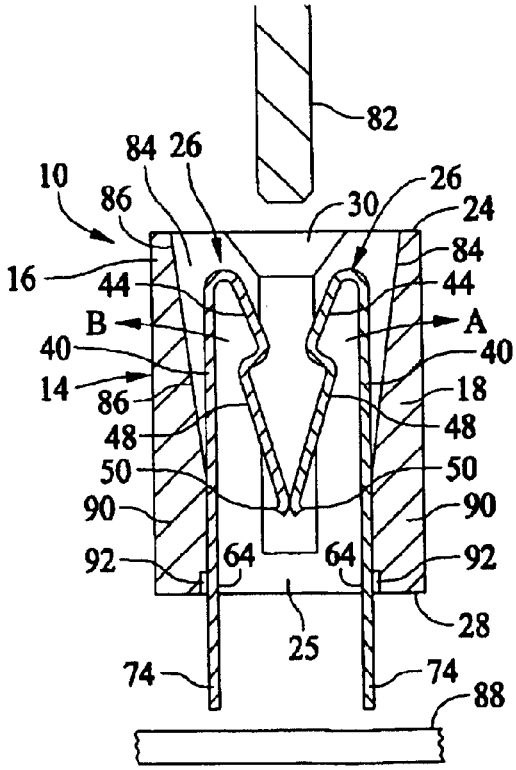
FIG. 3 is a cross sectional schematic view of the connector shown in FIG. 1 illustrating the contacts in a shorting position.

FIG. 3 illustrates a cross sectional view of the connector 10 taken along line 3—3 in FIG. 1 and through a plane containing opposed contacts 26. The housing 14 includes a notch 25 therein in which a contact pair 27 of contacts 26 are disposed in a mating opposing pair wherein the respective shorting contact sections 48 of the contacts 26 face one another. The rear legs 40 of the contacts 26 are separated from the housing 14 at their upper ends, thereby providing clearance gaps 84 between the rear legs 40 and outwardly tapered side walls 86 in the notches 25 in the interior of the housing 14 The opposing shorting contact sections 48 are urged together due to the resiliency of the respective contacts 26 and a shorting type electrical connection is effected between the contacts 26. The contact interfaces 50 engage one another to provide an electrical connection (a shorting connection) between the mated contacts 26. A daughter board 82 having an electrical circuit thereon may be inserted into the slot 30 in the upper edge 24 of the housing 14 and between the mated shorting contact sections 48 of the contacts 26. The compliant pin leads 74 are electrically connected to a mother board 88.

When the daughter board 82 is inserted into the connector 10, the daughter board 82 initially engages the guide sections 44 of the opposed contacts 26. As the daughter board 82 is further inserted, the rear legs 40 of the respective contacts 26 flex about the sections 64 and upper portions of the rear legs 40 extend outwardly in the direction of arrows A and B into clearance gaps 84 defined by outwardly tapered side walls 86 in the notches 25 in the interior of the housing 14. As illustrated, a thickness of the side walls 16 and 18 is thicker near the bottom edge 28 of the housing 14 than near the upper edge 24. A lower portion 90 of the housing 14 has a substantially constant wall thickness for sturdy support of head sections 54 (shown in FIG. 2) of the respective contacts 26. Cutouts 92 are included in the lower periphery of the lower portion 90 which receive the respective positioning tabs 70 (shown in FIG. 2) of the contacts 26.

Figure 4:
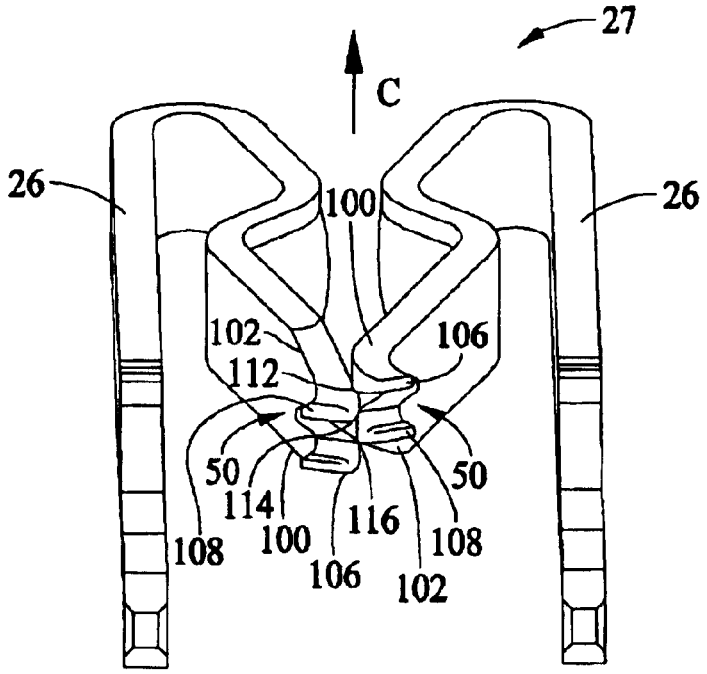
FIG. 4 is an end view of the contacts in the shorting position.
Figure 5:
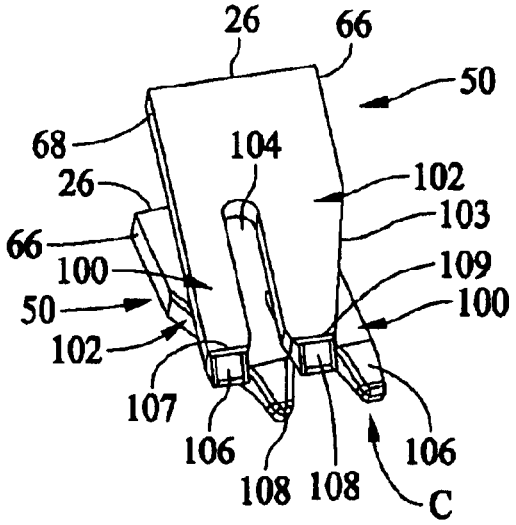
FIG. 5 is a magnified view of a shorting interface for the contacts shown in FIG. 4.

FIG. 4 illustrates contacts 26 in a contact pair 27 when in mating engagement with one another in the position shown in FIG. 3, and FIG. 5 is a perspective view of the contact interface 50 of the contacts 26. Each contact interface 50 is furcated with two or more furcations which, as described below, establish redundant points of contact between the contact interfaces 50. In an exemplary embodiment each contact interface 50 includes two furcations (i.e., a bifurcated contact interface) in the form of contact beams 100 and 102. A bifurcated interface, however, is described in this manner solely for purposes of explanation. It is not intended that the invention be so limited to a bifurcated interface.

As best seen in FIG. 5, in an illustrative embodiment the interfaces 50 each include a straight contact finger or beam 100 and a tapered contact finger or beam 102. The straight and tapered contact beams 100, 102 are separated by a slot 104, thereby providing a forked interface. The straight contact beam 100 extends coextensively with the side edge 68 of the contact 26 and is of a substantially constant width and thickness. The tapered contact beam 102 is formed with a contour that is inwardly displaced from the side edge 66 of the contact 26. The tapered contact beam 102 is located adjacent the straight contact beam 100 and is tapered in width along an outer side 103 thereof toward the straight contact beam 100. The taper provided in the tapered contact beam 102 facilitates an offset of the straight and tapered contact beams 100 and 102 relative to one another when the contact interfaces 50 are engaged. Thus, the tapered contact beam 102 of one of the contacts 26 is located proximate the slot 104 of the facing contact 26 when the contact interfaces 50 are engaged, and vice versa. The resiliency of the contacts 26 provides a wedge effect between the contact beams 100 and 102 of the respective contacts 26 for reliable electrical connection. That is, the contact beams 100, 102 are pressed against one another to ensure engagement of the respective contact interfaces 50.

As illustrated in FIGS. 4 and 5, each contact interface 50 includes the straight contact beam 100 and the tapered contact beam 102, and contoured footings 106 and 108 extend longitudinally from the distal ends 107 and 109, respectively, of the beams 100 and 102. The footings 106, 108 curve outwardly and away from the distal ends 107 and 109 of the contact beams 100, 102. Additionally, the footings 106 and 108 are tapered on the lateral inner sides thereof adjacent the slot 104 (FIG. 5). The lateral and longitudinal curvature of the footings 106 and 108 promotes point contact between the shorting interfaces 50 of each of the contacts 26 and reduces frictional forces and rubbing of the contact interfaces 50 during engagement and disengagement. As the contact interfaces 50 are engaged, the footings 106 and 108 of the respective contacts 26 initially engage one another. Due to the resiliency of the contacts 26, engagement between the contact interfaces 50 is under high stress to maintain the interfaces 50 in engagement with one another. Also due to the resiliency and the configurations of the contact interfaces 50, the footings 106 and 108 and/or the beams 100, 102 wipe against one another in a sliding movement in the direction of arrow C and come to engage one another in a mated position.

Additionally, and as best illustrated in FIG. 4, the configuration of the contact interfaces 50 produces redundant points of contact between the contact interfaces 50. In the exemplary embodiment there are three separate points of contact 112, 114, 116 for each contact interface 50. Specifically, each of the straight contact beams 100 includes one point of contact 112 on the footing 106 adjacent the tapered contact beam 102 of the opposing mating interface 50. Additionally, each of the footings 108 of the tapered beams 102 provides two points of contact 114, 116 with the mating contact interface 50, one on either side of the footing 108 By providing multiple points of contact 112, 114, 116 between the contact interfaces 50 it may be ensured that electrical contact will be established despite potential misalignment between the mating contact interfaces 50.

Additionally, the multiple points of contact 112, 114, 116 ensure contact between the contact interfaces 50 despite manufacturing limitations and tolerances in fabricating the contact interfaces 50. For example, in the exemplary embodiment providing three separate points of contact 112, 114, 116 as described above, it can be ensured that at least two of the points of contact 112, 114, 116 in any combination, if not all three points of contact, will be established when the contact interfaces 50 are engaged.

While the illustrated embodiment provides three points of contact, one may obtain more or less than three points of contact by varying the number of contact beams, the dimension of the beams and/or the separation between the beams on each contact interface 50.

Figure 6:
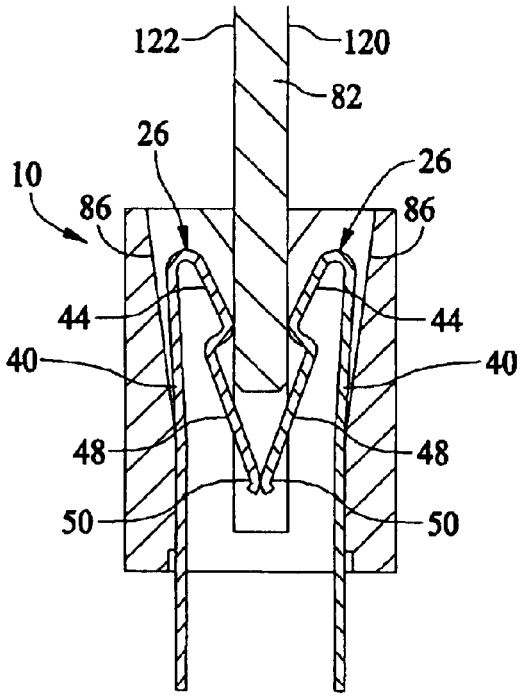
FIG. 6 is a cross sectional schematic view of the connector shown in FIG. 1 with a partially mated printed circuit board.

FIG. 6 illustrates the connector 10 with the daughter board 82 inserted therein in an intermediate or partially mated position. The guide sections 44 of the opposed contacts 26 are engaged by the surfaces 120 and 122 of the daughter board 82 and are deflected outwardly. Deflection of the guide sections 44 causes the rear legs 40 of the respective contacts 26 to flex about the respective sections 64 (shown in FIG. 2) such that the upper portions of the rear legs 40 are deflected outward toward the tapered side walls 86 of the housing 14. The contact sections 48 of the respective contacts 26, however, remain engaged to provide shorting electrical contact therebetween through the contact interfaces 50. As such, even though the daughter board 82 is partially mated to the connector 10, the contacts 26 continue to provide an electrical shorting connection.

Figure 7:
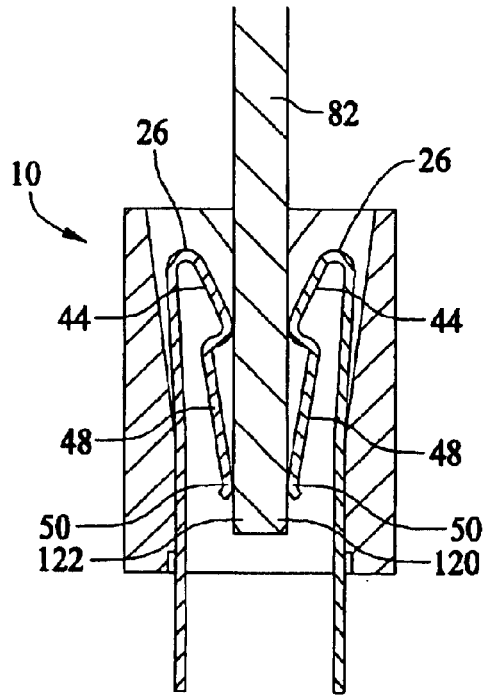
FIG. 7 is a cross sectional schematic view of the connector shown in FIG. 1 with a fully mated printed circuit board.

FIG. 7 illustrates the connector 10 with the daughter board 82 inserted therein in a fully mated position. The guide sections 44 of the opposed contacts 26 remain in contact with the opposed surfaces 120 and 122 of the daughter board 82 and the opposed surfaces 120 and 122 of the daughter board 82 separate the contact sections 48 and the contact interfaces 50 from one another. The shorting connection is broken between the contact sections 48 and an electrical connection is established solely through the daughter board 82. The contacts 26 mate with the daughter board 82 before breaking the short circuit connection. Electrical malfunction and damage to components and equipment by an improperly or incompletely connected daughter board 82 is therefore avoided with mate-before-break engagement of the contacts 26.

When the daughter board 82 is removed from the connector 10, the contacts 26 resiliently spring back into the position shown in FIG. 3 wherein the shorting connection between the contacts 26 is securely established with multiple points of contact.

An electrical card edge connector is therefore provided which assures a high reliability of electrical connection despite the presence of debris and film on the contact interface while overcoming difficulties associated with misalignment of the shorting contacts. Wiping movement between the respective multiple points of contact between the mating interfaces overcomes accumulation of film or debris on the respective shorting contacts and provides a highly reliable electrical connection. Mate-before-break connection of the daughter board to the connector ensures shorting connection of the contacts until the daughter board is fully mated to the connector.

While the invention has been described in terns of various specific embodiments, those skilled in the art will recognize that the invention can be practiced with modification within the spirit and scope of the claims.

What is claimed is:

1. A contact system comprising:

at least one opposed pair of contacts, each of said contacts of said pair comprising:

a resilient rear leg;

a guide eon extending from said rear leg; and a contact interface extending from said guide section, said contact interface comprising a furcated surface having a first contact beam and a second contact beam, one of said first and second beams tapered in width, the other of said first and second beams substantially constant in width, said first and second contact beams adapted to establish multiple points of contact with a mating contact interface.

2. A contact system in accordance with claim 1 wherein said first contact beam and said second contact beam are separated by a slot.

3. A contact system in accordance with claim 1 wherein at least one contoured footing extends from one of said first and second contact beams, said contoured footing curved in a longitudinal direction and a lateral direction.

4. A contact system in accordance with claim 1 wherein said furcated surface is adapted to establish three points of contact with a mating contact interface.

5. A contact system in accordance with claim 1 wherein said first and second contact beams of one of said contacts of said pair are offset from the contact beams of the other of said contact beams of said pair.

6. An electrical connector comprising:

a pair of contacts arranged opposed to one another, each of said contacts comprising a furcated contact interface defining first and second contact beams, said furcated contact interface of said pair of contacts engaging one another wherein said first and second contact beams of one of the pair of contacts are offset from the first and second contact beams of the other said pair of contacts, thereby establishing multiple points of contact until a printed circuit board is fully inserted between said contact interfaces.

7. An electrical connector in accordance with claim 6 wherein said first contact beam and said second contact beam are separated by a slot.

8. An electrical connector in accordance with claim 6 wherein each of said first and second contact beams has contoured footing extending from said contact beam, said contoured footing is curved in a longitudinal direction and is curved in a lateral direction for wiping engagement with a mating contact interface.

9. An electrical connector in accordance with claim 6 wherein said furcated contact interfaces are bifurcated into said first and second contact beams.

10. An electrical connector in accordance with claim 6 further comprising a housing having tapered interior walls, said pair of contacts having resilient rear legs that flex toward said tapered interior walls when a printed circuit board in partly inserted between the contacts.

11. An electrical connector comprising:

a housing configured to receive a circuit board and comprising at least one tapered interior wall; and a pair of contacts provided in said housing and arranged opposed to one another, at least one of said pair of contacts comprising a resilient rear leg situated adjacent said tapered interior wall and a resilient contact section extending from said rear leg, said contact section including a furcated contact interface comprising a first contact beam and a second contact beam, one of said first and second contact beams adapted to create separate first and second points of contact with an opposed contact of said pair.

12. An electrical connector in accordance with claim 11 further comprising a slot separating said first contact beam and said second contact beam.

13. An electrical connector in accordance with claim 11 further comprising a contoured footing extending from at least one of said first and second contact beam, said footing adapted for wiping engagement with a mating contact interface.

14. An electrical connector in accordance with claim 11 wherein the other of said first and second contact beams creates a third point of contact when said contact interface is engaged to a mating contact interface.

15. An electrical connector in accordance with claim 11, wherein said housing includes a notch having a clearance gap defined by said tapered interior wall, said at least one contact having a resilient rear leg that flexes toward said clearance gap proximate said tapered interior wall.

16. An electrical card edge connector comprising:

a housing configured to receive an edge of a circuit board; and first and second contacts situated in said housing and arranged in a mating opposite pair, at least one of said first and second contacts comprising:

a resilient rear leg situated adjacent a tapered interior wall of said housing;

a guide section extending from said rear leg, said guide section engaging the circuit board as the circuit board is received in said housing; and a resilient contact interface extending from said guide section;

wherein said contact interface comprises a furcated contact interface engaging a mating contact interface offset from said contact interface and establishing redundant points of contact therebetween until the circuit board is fully inserted between said first and second contacts, said resilient leg flexing when the circuit board engages said guide section to receive the printed circuit board without separating said contact interfaces from one another until the circuit board is inserted a predetermined distance into said slot.

17. An electrical card edge connector in accordance with claim 16 wherein each of said pair of contacts includes a bifurcated contact interface.

18. An electrical card edge connector in accordance with claim 16 wherein said resilient rear leg includes a section of reduced cross sectional area.

19. An electrical connector comprising:

a pair of contacts opposed to one another, at last one of said pair of contacts comprising a resilient rear leg and a resilient contact section extending from said rear leg, said contact section including a furcated contact interface comprising a first contact beam and a second contact beam, one of said first and second contact beams adapted to create separate first and second points of contact with an opposed contact of said pair.

* * * * *